US009617877B2

(12) United States Patent
Nagura et al.

(10) Patent No.: US 9,617,877 B2
(45) Date of Patent: Apr. 11, 2017

(54) VALVE OPENING AND CLOSING TIMING CONTROL DEVICE

(71) Applicant: AISIN SEIKI KABUSHIKI KAISHA, Kariya-shi, Aichi-ken (JP)

(72) Inventors: Kentaro Nagura, Paris (FR); Hiromitsu Shigyo, Toyota (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 57 days.

(21) Appl. No.: 14/854,809

(22) Filed: Sep. 15, 2015

(65) Prior Publication Data

US 2016/0076409 A1 Mar. 17, 2016

(30) Foreign Application Priority Data

Sep. 16, 2014 (JP) ..... 2014-187808

(51) Int. Cl.
*F01L 1/34* (2006.01)

(52) U.S. Cl.
CPC ..... *F01L 1/34* (2013.01)

(58) Field of Classification Search
CPC ..... F01L 1/34
USPC ..... 123/90.17
See application file for complete search history.

(56) References Cited

U.S. PATENT DOCUMENTS 6,443,112 B1 * 9/2002 Kinugawa ..... F01L 1/3442 123/90.17
2012/0097122 A1 4/2012 Lichti

FOREIGN PATENT DOCUMENTS

JP 2009-515090 A 4/2009
WO WO 2007/051704 A 5/2007

* cited by examiner

*Primary Examiner* — Zelalem Eshete
(74) *Attorney, Agent, or Firm* — Buchanan Ingersoll & Rooney PC

(57) ABSTRACT

A valve opening and closing timing control device includes: a driving-side rotating body coaxial with a rotational axis and rotated in synchronization with an internal combustion engine crankshaft; a driven-side rotating body coaxial with the rotational axis and integrally rotated with a valve opening and closing cam shaft; a connecting member screwed into the cam shaft for connecting the driven-side rotating body to the cam shaft and having a pump port to which a fluid is supplied, an advance angle port communicating with an advance angle chamber, and a retarded angle port communicating with an retarded angle chamber; a spool accommodated within a space of the connecting member to reciprocally move between advance angle, neutral, and retarded angle positions along the rotational axis; and an actuator causing a pressing force to act along rotational axis and operates the spool to be in the neutral, advance angle, or retarded angle positions.

4 Claims, 7 Drawing Sheets

VALVE OPENING AND CLOSING TIMING CONTROL DEVICE

CROSS REFERENCE TO RELATED APPLICATIONS

This application is based on and claims priority under 35 U.S.C. §119 to Japanese Patent Application 2014-187808, filed on Sep. 16, 2014, the entire contents of which are incorporated herein by reference.

TECHNICAL FIELD

This disclosure relates to a valve opening and closing timing control device and, specifically, to improvement of a device for controlling a fluid by operating a spool which is disposed coaxially with a cam shaft and controlling a relative rotational phase between a driving-side rotating body and a driven-side rotating body of the valve opening and closing timing control device.

BACKGROUND DISCUSSION

As the valve opening and closing timing control device having the configuration described above, a technique is disclosed in JP2009-515090T in which a valve housing is screwed and fixed to an inside of the cam shaft, a pressure medium guidance insert is disposed on an inside of the valve housing, a control piston (spool) is disposed on the inside of the valve housing so as to be movable in a direction along an axis of the cam shaft, and the control piston is operated by an external electrical adjustment unit (actuator).

In JP2009-515090T, a pair of ports communicating with a pressure chamber for controlling the relative rotational phase is formed on an inner surface of the pressure medium guidance insert and a flow path for supplying a pressure medium supplied to the valve housing to the control piston through a flow path between the inner surface of the valve housing and the pressure medium guidance insert is formed.

Furthermore, a technique is disclosed in US2012/0097122A1 in which an attachment bolt is screwed and fixed to an inside of a cam shaft, a spool is disposed on the inside thereof so as to be movable in a direction along an axis of the cam shaft, and the spool is operated by an external actuator.

In US2012/0097122A1, a pair of ports communicating with an advance angle chamber and a retarded angle chamber is formed in an inner surface of the attachment bolt, a flow path for supplying a fluid supplied to the cam shaft to the spool by allowing the fluid to pass through a part of a flow path forming member on an outer periphery of the cam shaft is formed.

As disclosed in JP2009-515090T and US2012/0097122A1, the valve opening and closing timing control device for controlling the fluid by the spool provided coaxially with the cam shaft performs supply and discharge of the fluid from a position in the vicinity of the advance angle chamber or the retarded angle chamber. Thus, it is possible to rapidly operate the valve opening and closing timing control device by suppressing operation delay caused by flow path resistance.

However, in this configuration, since the spool is disposed coaxially with the cam shaft, the fluid is supplied from an external fluid pressure pump of the cam shaft and the fluid is supplied to the spool through the flow path formed in the cam shaft.

As described above, when considering the configuration in which the flow path is formed in the cam shaft, in the technique disclosed in JP2009-515090T, since the flow path is formed by forming the pressure medium guidance insert on the inside of the valve housing, the number of components is increased and it leads to a cost increase. Furthermore, in this configuration, it is likely to lead to leakage of the fluid between the valve housing and the pressure medium guidance insert, and to lead to performance degradation due to the flow path resistance caused by a bending flow path.

In the technique disclosed in US2012/0097122A1, the flow path is formed by disposing the flow path forming member on the outer periphery of the attachment bolt. Thus, similar to JP2009-515090T, the number of components is increased, it leads to a cost increase, and it is likely to lead to leakage of the fluid, and lead to performance degradation.

SUMMARY

Thus, a need exists for a valve opening and closing timing control device which is not suspectable to the drawback mentioned above.

A valve opening and closing timing control device according to an aspect of this disclosure includes a driving-side rotating body that is disposed coaxially with a rotational axis and rotates in synchronization with a crankshaft of an internal combustion engine; a driven-side rotating body that is disposed coaxially with the rotational axis and integrally rotates with a valve opening and closing cam shaft; a connecting member that is screwed into the cam shaft for connecting the driven-side rotating body to the cam shaft and has a pump port to which a fluid is supplied, an advance angle port which communicates with an advance angle chamber formed by being partitioned by the driving-side rotating body and the driven-side rotating body, and a retarded angle port which communicates with an retarded angle chamber formed by being partitioned by the driving-side rotating body and the driven-side rotating body; a spool that is accommodated within an internal space of the connecting member so as to reciprocally move between an advance angle position, a neutral position, and a retarded angle position along the rotational axis; and an actuator that causes a pressing force to act in a direction along rotational axis and operates the spool to be in the neutral position, the advance angle position, or the retarded angle position, in which when the spool is in the neutral position, the pump port is maintained in a state of not communicating with the advance angle port and the retarded angle port, when the spool is in the advance angle position, the pump port communicates with the advance angle port, and when the spool is in the retarded angle position, the pump port communicates with the retarded angle port, and a fluid supply path allowing the fluid supplied from an external pump to flow into the pump port is formed in the connecting member and the fluid supply path reaches the pump port from an outside position so as to be along the rotational axis more than the advance angle port or the retarded angle port.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
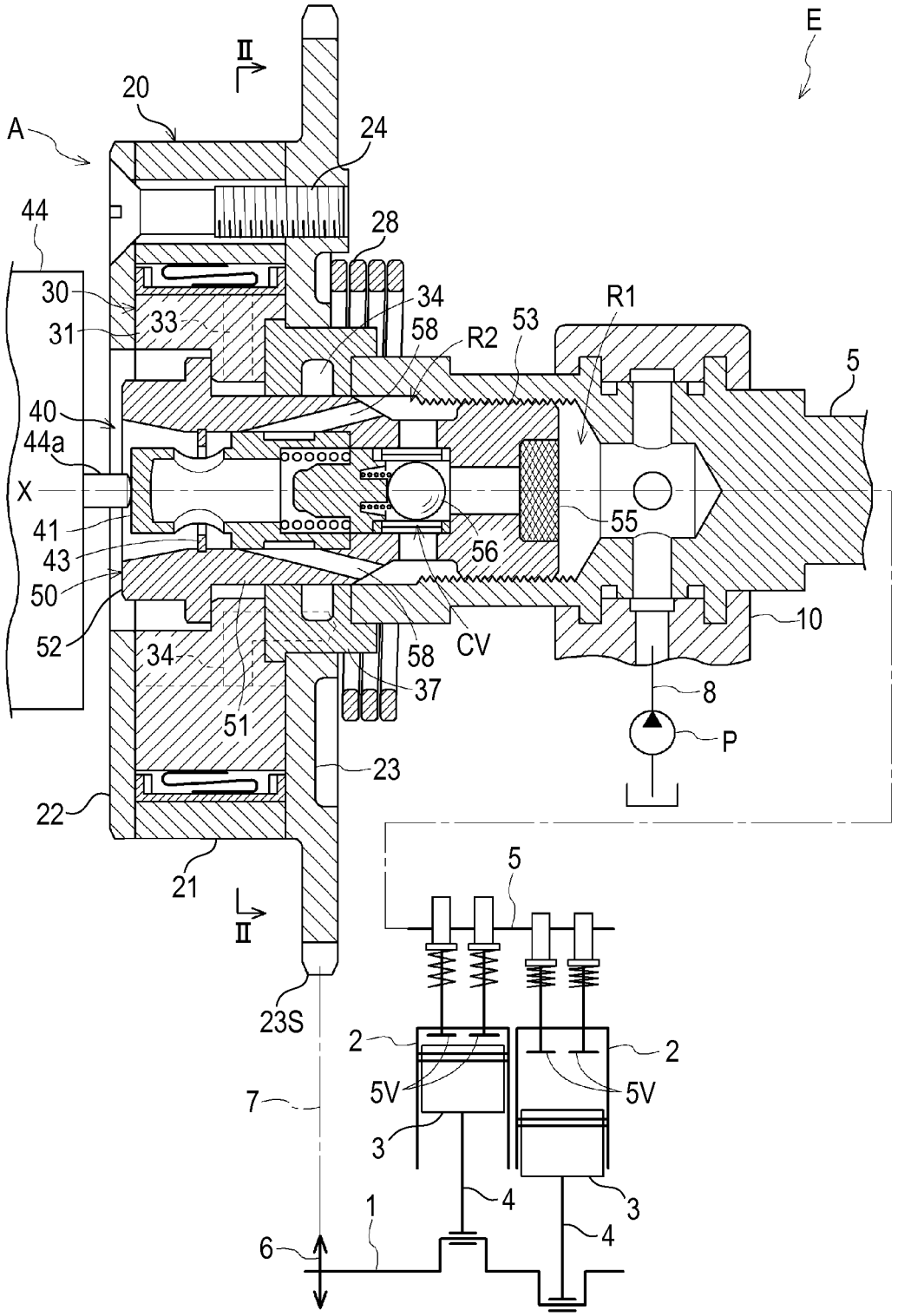
FIG. 1 is a sectional view of a valve opening and closing timing control device.

Hereinafter, embodiments will be described with reference to the drawings.

Basic Configuration

As illustrated in FIGS. 1 to 5, a valve opening and closing timing control device A is configured to include an outer rotor 20 (an example of a driving-side rotating body) that rotates in synchronization with a crankshaft 1 of an engine E as an internal combustion engine and an inner rotor 30 (an example of a driven-side rotating body) that integrally rotates coaxially with an intake cam shaft 5 of a combustion chamber of the engine E so as to be relatively rotatable about a rotational axis X of the intake cam shaft 5.

The valve opening and closing timing control device A includes the inner rotor 30 with respect to the outer rotor 20 and the inner rotor 30 is connected to the intake cam shaft 5 by a connecting bolt 50 (an example of a connecting member) passing through a center position. A spool 41 is accommodated in an internal space of the connecting bolt 50 coaxially with the rotational axis X (matching an axis of the bolt) so as to be reciprocally operated along the rotational axis X and the spool 41 is biased in a protruding direction by a spool spring 42. Furthermore, in the valve opening and closing timing control device A, the spool 41 and the spool spring 42 are integrally rotated with the inner rotor 30.

An electromagnetic solenoid 44 is supported on the engine E as an actuator for operating the spool 41. The electromagnetic solenoid 44 includes a plunger 44*a* that protrudes by an amount directly proportional to power supplied to a solenoid on the inside thereof and the plunger 44*a* is disposed at a position capable of abutting an outer end of the spool 41. An electromagnetic control valve 40 is configured of the spool 41, the spool spring 42, and the electromagnetic solenoid 44.

The valve opening and closing timing control device A changes a relative rotational phase between the outer rotor 20 and the inner rotor 30 by control of hydraulic oil (an example of a fluid) by the electromagnetic control valve 40 and thereby control of opening and closing timing of an intake valve 5V is performed.

The engine E (an example of the internal combustion engine) of FIG. 1 is illustrated as being included in a vehicle such as a passenger car. The engine E is configured of a 4-cycle type in which a piston 3 is accommodated on an inside of a cylinder bore of a cylinder block 2 at an upper position of the crankshaft 1 and the piston 3 and the crankshaft 1 are connected by a connecting rod 4.

The intake cam shaft 5 which is operated to open and close the intake valve 5V and an exhaust cam shaft (not illustrated) are provided in an upper portion of the engine E. The engine E includes a hydraulic pump P (an example of a hydraulic pump) that is driven by the crankshaft 1.

A supply flow path 8 for supplying hydraulic oil from the hydraulic pump P is formed in an engine configuring member 10 supporting the intake cam shaft 5 in a rotatable manner. The hydraulic pump P supplies lubricant stored in an oil pan of the engine E to the electromagnetic control valve 40 through the supply flow path 8 as hydraulic oil (an example of the fluid).

A timing chain 7 is wound around an output sprocket 6 formed in the crankshaft 1 of the engine E and a timing sprocket 23S of the outer rotor 20. Thus, the outer rotor 20 and the crankshaft 1 rotate in synchronization with each other. A sprocket is also provided in a front end of the exhaust cam shaft on an exhaust side and the timing chain 7 is also wound around the sprocket.

Figure 2:
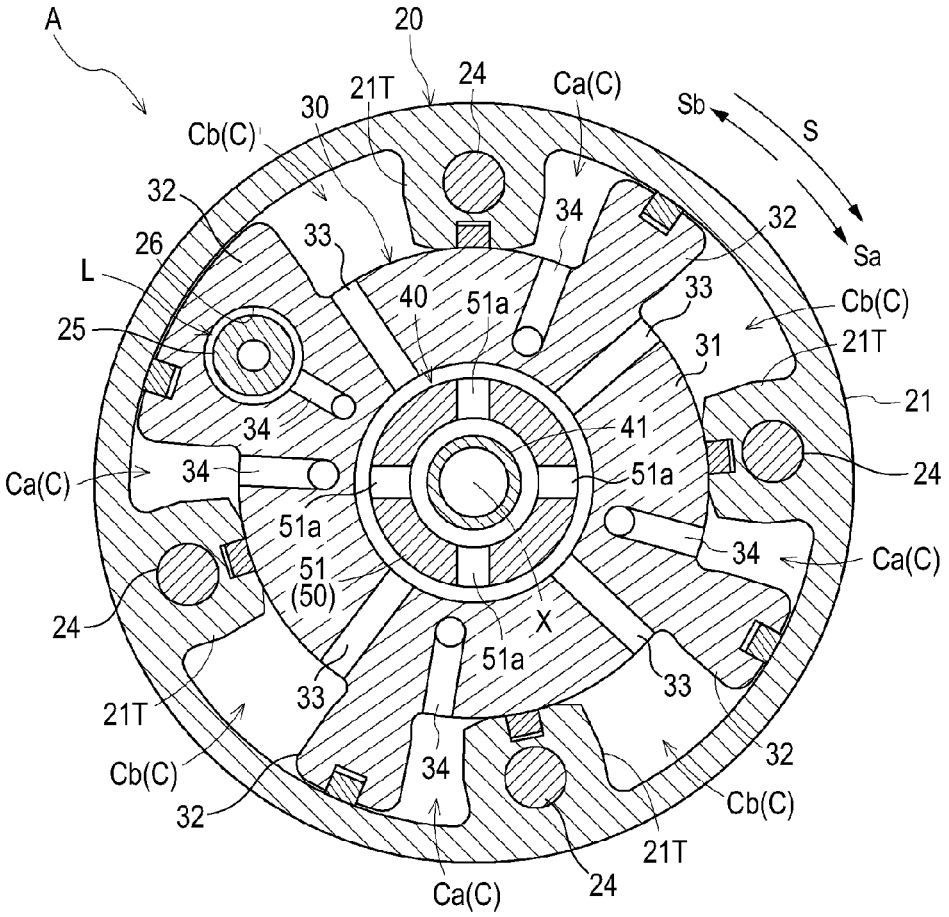
FIG. 2 is a sectional view that is taken along line II-II of FIG. 1.

As illustrated in FIG. 2, in the valve opening and closing timing control device A, the outer rotor 20 is rotated toward a drivingly rotating direction S by a driving force from the crankshaft 1. Furthermore, a direction in which the inner rotor 30 relatively rotates in the same direction as the drivingly rotating direction S with respect to the outer rotor 20 is referred to as an advance angle direction Sa and a reverse direction thereof is referred to as a retarded angle direction Sb. In the valve opening and closing timing control device A, a relationship between the crankshaft 1 and the intake cam shaft 5 is set such that an intake compression ratio is enhanced with an increase in a displacement amount when a relative rotational phase is displaced in the advance angle direction Sa and the intake compression ratio is reduced with an increase in the displacement amount when the relative rotational phase is displaced in the retarded angle direction Sb.

Furthermore, in the embodiment, the valve opening and closing timing control device A is provided in the intake cam shaft 5, but the valve opening and closing timing control device A may be provided in the exhaust cam shaft or may be provided in both the intake cam shaft 5 and the exhaust cam shaft.

Valve Opening and Closing Timing Control Device

The valve opening and closing timing control device A includes the outer rotor 20 and the inner rotor 30, and is configured to include a bush-shaped adapter 37 which is interposed between the inner rotor 30 and the intake cam shaft 5.

The outer rotor 20 has an outer rotor body 21, a front plate 22, and a rear plate 23, and these are integrated by fastening of a plurality of fastening bolts 24. The timing sprocket 23S is formed on an outer periphery of the rear plate 23. Furthermore, the timing sprocket 23S may be integrally formed with the outer rotor body 21.

A plurality of protrusion sections 21T protruding inwardly in a radial direction based on the rotational axis X are integrally formed in the outer rotor body 21. The inner rotor 30 has a cylindrical inner rotor body 31 coming into close contact with a protruding end of the protrusion section 21T of the outer rotor body 21 and four vane sections 32 that are provided to protrude to an outer periphery of the inner rotor body 31 so as to come into contact with an inner peripheral surface of the outer rotor body 21. Furthermore, the number of the vane sections 32 may be other than four.

Thus, the outer rotor 20 includes the inner rotor 30 and a plurality of fluid pressure chambers C are formed at intermediate positions of the adjacent protrusion sections 21T in the rotating direction on the outer periphery side of the inner rotor body 31. The fluid pressure chambers C are partitioned by the vane sections 32 and an advance angle chamber Ca and a retarded angle chamber Cb are defined and formed.

An advance angle flow path 34 communicating with the advance angle chamber Ca is formed over the inner rotor 30 and the adapter 37, and a retarded angle flow path 33 communicating with the retarded angle chamber Cb is formed over the inner rotor 30 and the adapter 37.

As illustrated in FIG. 1, a torsion spring 28, which assists a displacement of the relative rotational phase (hereinafter, referred to as the relative rotational phase) of the outer rotor 20 and the inner rotor 30 in the advance angle direction Sa by causing a biasing force to act from the most retarded angle phase in the advance angle direction Sa, is provided over the adapter 37 and the rear plate 23.

Furthermore, a lock mechanism L for locking (fixing) the relative rotational phase of the outer rotor 20 and the inner rotor 30 to the most retarded angle phase is provided. The lock mechanism L is configured to include a lock member 25 that is guided to be freely advanced and retracted with respect to a guide hole 26 in the rotational axis X for one vane section 32, a lock spring that biases the lock member 25 to protrude, and a lock concave section that is formed in the rear plate 23. Furthermore, the lock mechanism L may be configured to include the lock member 25 that is guided in the guide hole 26 so as to move along the radial direction.

The lock mechanism L functions such that the relative rotational phase reaches the most retarded angle phase, the lock member 25 engages with the lock concave section by the biasing force of the lock spring, and the relative rotational phase is maintained in the most retarded angle phase. Furthermore, if the advance angle flow path 34 communicates with the lock concave section and hydraulic oil is supplied to the advance angle flow path 34, it is configured to allow the lock member 25 to be disengaged from the lock concave section to be unlocked by a pressure of hydraulic oil.

Valve Opening and Closing Timing Control Device: Connecting Bolt

As illustrated in FIGS. 1 and 3 to 7, the connecting bolt 50 is configured such that a bolt head section 52 is formed in an outer end portion of a cylindrical bolt body 51, a male screw section 53 is formed in an inner end portion, the male screw section 53 engages with a female screw section of the intake cam shaft 5, and thereby the inner rotor 30 and the adapter 37 are fastened and fixed to the intake cam shaft 5.

A spool chamber 50*a* (an example of an inner space of the connecting member) in which the spool 41 is accommodated, an intermediate hole section 50*b*, and a leading end opening 50*c* are formed on an inside of the connecting bolt 50 coaxially with the rotational axis X. The spool chamber 50*a* is formed in a cylinder inner surface shape and the spool 41 described above is accommodated so as to reciprocally move along the rotational axis X. A spring holder 54 is provided at a position adjacent to the spool chamber 50*a* of the intermediate hole section 50*b*. The spool chamber 50*a* and the intermediate hole section 50*b* are in a non-communicated state by closing a part of the intermediate hole section 50*b* by the spring holder 54. An oil filter 55 is supported by the leading end opening 50*c* and the leading end opening 50*c* communicates with the intermediate hole section 50*b* through the oil filter 55.

A small diameter section is formed at a position adjacent to the male screw section 53 of an outer periphery of the bolt body 51 of the connecting bolt 50. A plurality of communication holes 50*d* that allow the small diameter section to communicate with the intermediate hole section 50*b* are formed in the radial direction. The intermediate hole section 50*b* includes a check valve CV that biases a ball 56 to a closed position by a ball spring 57. The spring holder 54 supports the ball spring 57 and also supports the spool spring 42.

In a state where the connecting bolt 50 is connected to the intake cam shaft 5, a first hydraulic oil chamber R1 to which hydraulic oil is supplied from the supply flow path 8 and a second hydraulic oil chamber R2 as a fluid supply space are formed inside the intake cam shaft 5.

That is, the first hydraulic oil chamber R1 is formed between an end surface of the connecting bolt 50 on an inner end side (right side in FIG. 1) and an inner periphery of the intake cam shaft 5 by connecting the connecting bolt 50 to the intake cam shaft 5. The first hydraulic oil chamber R1 communicates with the supply flow path 8 and at this time, communicates with the leading end opening 50*c* of the connecting bolt 50 through the oil filter 55.

Furthermore, the second hydraulic oil chamber R2 (an example of the fluid supply space) is formed at a position adjacent to the first hydraulic oil chamber R1 between the inner periphery of the intake cam shaft 5 and the outer periphery of the small diameter section of the connecting bolt 50. The second hydraulic oil chamber R2 communicates with the communication hole 50*d* of the connecting bolt 50 and at this time, communicates with a fluid supply path 58 in a posture inclined with respect to the rotational axis X.

Furthermore, if a pressure of hydraulic oil supplied from the hydraulic pump P to the first hydraulic oil chamber R1 exceeds a predetermined value, the check valve CV performs an operation to open the leading end opening 50*c* and if the pressure is less than the predetermined value, the check valve CV performs an operation to close the leading end opening 50*c*. Hydraulic oil from the advance angle chamber Ca or the retarded angle chamber Cb is prevented from flowing back and variation of a phase of the valve opening and closing timing control device A is suppressed when the pressure of hydraulic oil is dropped. Furthermore, the check valve CV performs the operation to close the leading end opening 50*c* even if a pressure of the check valve CV on a downstream side exceeds a predetermined value.

Valve Opening and Closing Timing Control Device: Electromagnetic Control Valve

Figure 6:
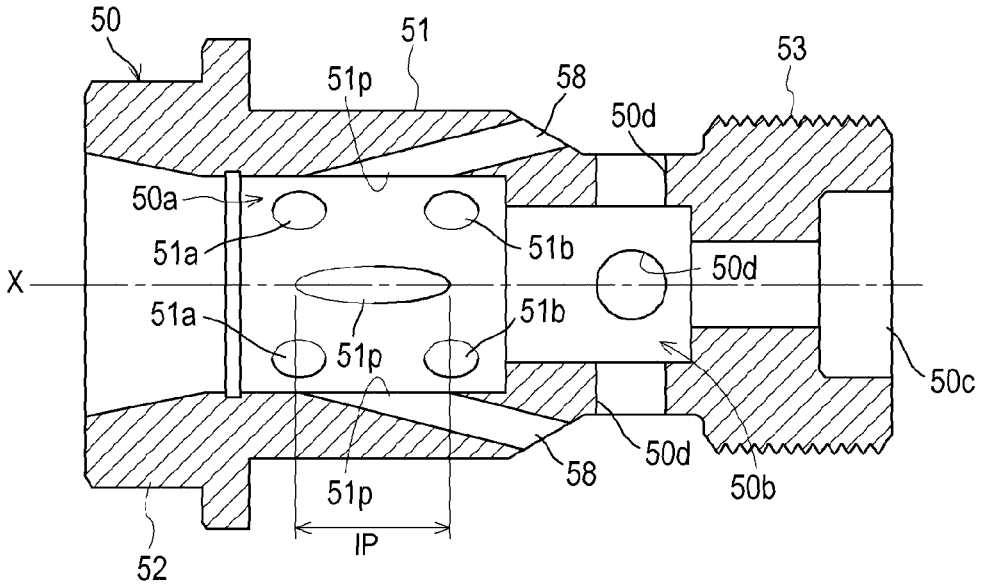
FIG. 6 is a sectional view of the connecting bolt.
Figure 7:
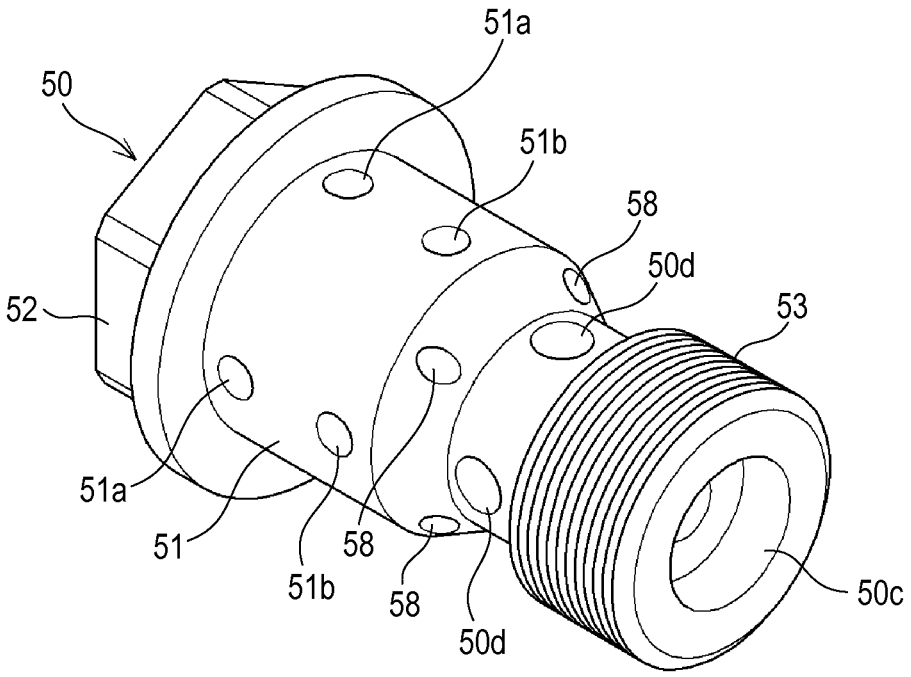
FIG. 7 is a perspective view of the connecting bolt.

As illustrated in FIG. 6, a plurality of pump ports 51*p* are formed on the inner surface of the bolt body 51 of the connecting bolt 50 and at this time, a plurality of retarded angle ports 51*a* and a plurality of advance angle ports 51*b* are formed at positions interposing the pump ports therebetween. Furthermore, in FIG. 6, the retarded angle ports 51*a*, the pump ports 51*p*, and the advance angle ports 51*b* are disposed in this order from the outer end side to the inner end side of the connecting bolt 50.

Since the second hydraulic oil chamber R2 is disposed on the inner end side (right side in FIG. 3) of the connecting bolt 50 further than the position of the advance angle port 51*b*, the fluid supply path 58 that is linearly formed between the second hydraulic oil chamber R2 and the plurality of pump ports 51*p* is inclined with respect to the rotational axis X. Furthermore, the fluid supply path 58 may not be necessarily linearly formed and, for example, may be formed in a bent shape or a curved shape.

The fluid supply path 58 is formed in the connecting bolt 50 (connecting member) so as to allow the fluid supplied from an external pump P to flow into the plurality of pump ports 51*p*. In addition, since the fluid supply path 58 is linearly formed in the posture inclined with respect to the rotational axis X, the pump port 51*p* formed in a portion in which the fluid supply path 58 is opened to the spool chamber 50*a* has a cross section of an elliptical shape extending in an inclined direction with respect to the rotational axis X. Furthermore, the retarded angle port 51*a* and the advance angle port 51*b* are formed to have a cross section of a simply circular shape.

Particularly, in the spool chamber 50*a*, the retarded angle port 51*a* and the advance angle port 51*b* are formed at positions deviated by a predetermined angle about the rotational axis X based on the pump port 51. Furthermore, a region where the pump port 51*p* is present in a direction along the rotational axis X and a region where the retarded angle port 51*a* and the advance angle port 51*b* are present in a direction along the rotational axis X are arranged so as to overlap each other at a part thereof.

That is, as illustrated in FIG. 6, assuming a pump port region IP in which the pump ports 51*p* are present in the direction along the rotational axis X, the pump port region IP is disposed to overlap a part of the retarded angle port 51*a* and the advance angle port 51*b*. Furthermore, in the embodiment disclosed here, a part of any one of the retarded angle port 51*a* and the advance angle port 51*b* may also be disposed so as to overlap the pump port region IP.

Figure 3:
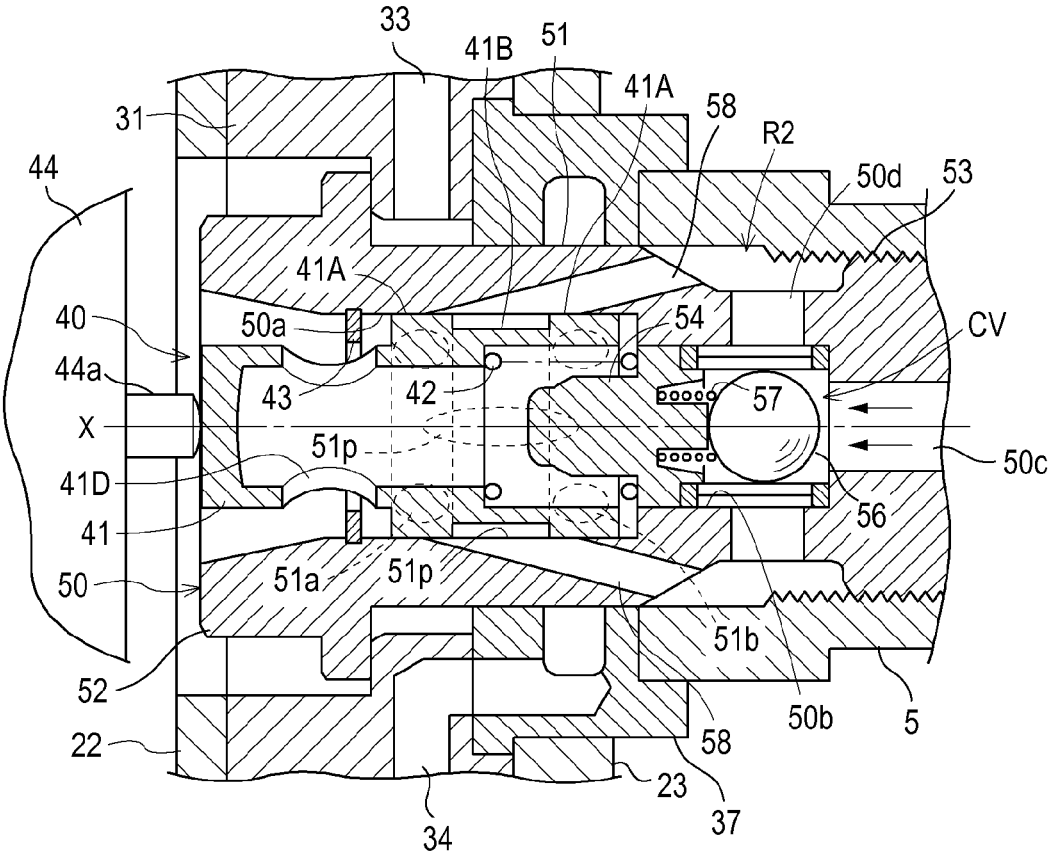
FIG. 3 is a sectional view of a connecting bolt in a state where a spool is in a neutral position.

As illustrated in FIGS. 2 and 3, the retarded angle port 51*a* communicates with the retarded angle flow path 33 formed in the inner rotor body 31 and the advance angle port 51*b* communicates with the advance angle flow path 34 formed in the adapter 37. In addition, the pump port 51*p* communicates with the second hydraulic oil chamber R2 through the linear fluid supply path 58.

Land sections 41A are formed in entire circumferences of both end portions of the spool 41 and an annular groove section 41B is formed in an entire circumference of an intermediate position of the land sections 41A. The inside of the spool 41 is hollow and a drain hole 41D is formed at a protrusion end of the spool 41. In addition, a stopper 43 is provided in an inner periphery of opening of the connecting bolt 50 on an outer end side.

Figure 4:
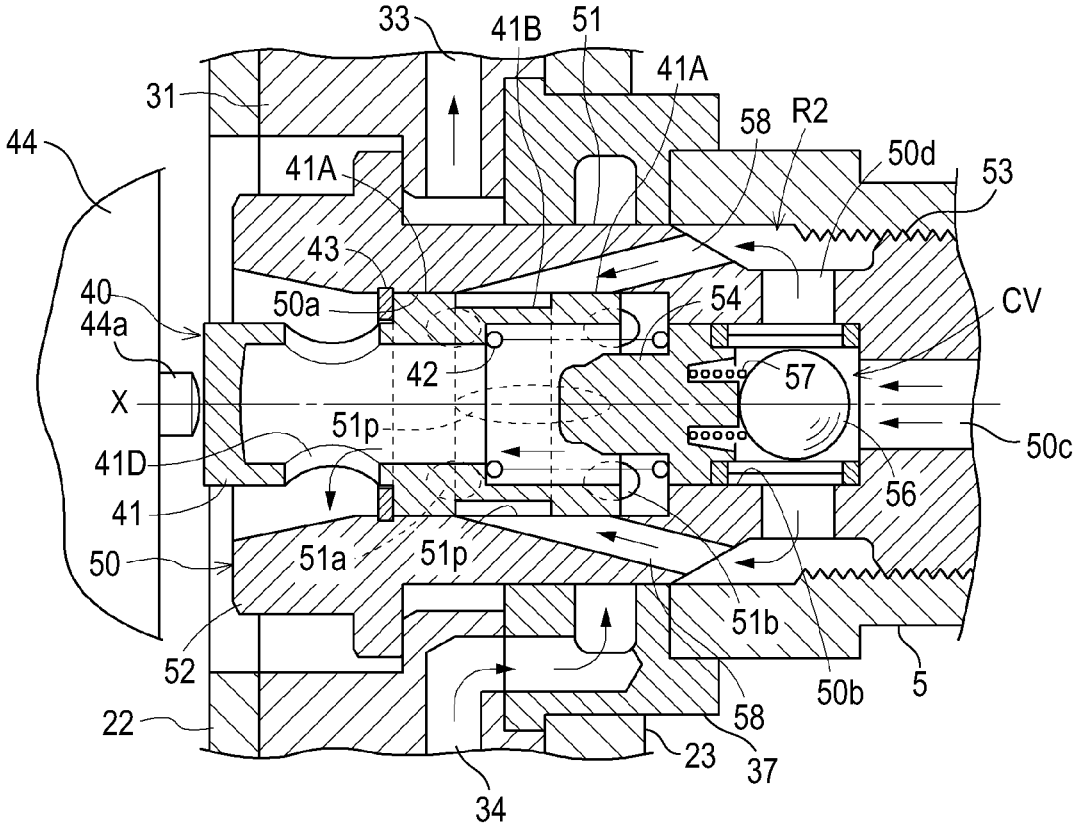
FIG. 4 is a sectional view of the connecting bolt in a state where the spool is in a retarded angle position.
Figure 5:
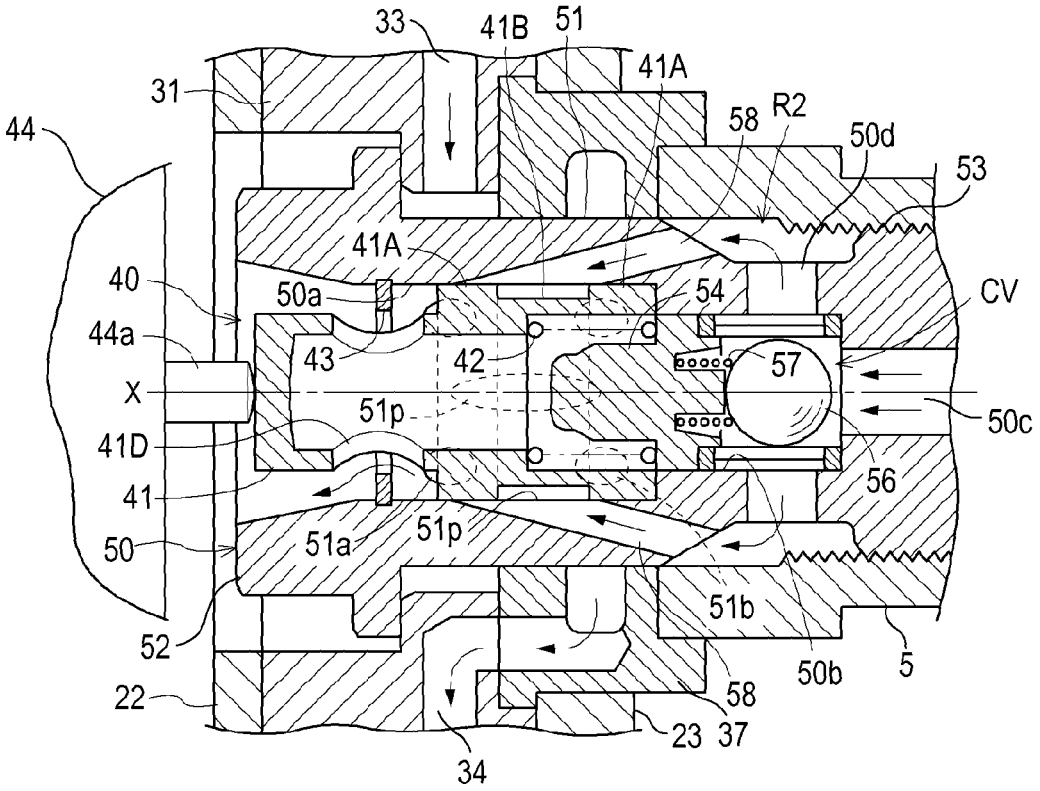
FIG. 5 is a sectional view of the connecting bolt in a state where the spool is in an advance angle position.

The electromagnetic control valve 40 is configured to allow a plunger 44*a* to abut the outer end portion of the spool 41 so as to control a protrusion amount and thereby, as illustrated in FIGS. 3 to 5, it is possible to operate the spool 41 to be in any one of a neutral position, a retarded angle position, and an advance angle position.

Control Form

That is, the retarded angle port 51*a* and the advance angle port 51*b* are closed by a pair of the land sections 41A of the spool 41 by setting the spool 41 to be in the neutral position illustrated in FIG. 3 by control of the electromagnetic solenoid 44. As a result, the phase of the valve opening and closing timing control device A is maintained without performing supplying and discharging hydraulic oil with respect to the advance angle chamber Ca and the retarded angle chamber Cb.

The plunger 44*a* is retracted (actuated outwardly) based on the neutral position and the spool 41 is set to be in the retarded angle position illustrated in FIG. 4 by control of the electromagnetic solenoid 44. Thus, one land section 41A allows the retarded angle port 51*a* to communicate with the pump port 51*p* through the groove section 41B. Simultaneously, the advance angle port 51*b* communicates with a drain space (space connected to the outer end side from the spool chamber 50*a* of the connecting bolt 50), hydraulic oil is supplied to the retarded angle chamber Cb, and at this time, hydraulic oil is discharged from the advance angle chamber Ca (flow of hydraulic oil is indicated by arrows in FIG. 4).

Thus, a rotational phase of the intake cam shaft 5 is displaced in the retarded angle direction Sb. Furthermore, the retarded angle position matches a position at which the spool 41 abuts the stopper 43 by a biasing force of the spool spring 42.

Furthermore, the plunger 44*a* is caused to protrude (actuated inwardly) based on the neutral position and the spool 41 is set to be in the advance angle position illustrated in FIG. 5 by control of the electromagnetic solenoid 44. Thus, the other land section 41A allows the advance angle port 51*b* to communicate with the pump port 51*p* through the groove section 41B. Simultaneously, the retarded angle port 51*a* communicates with a drain space (space connected to the drain hole 41D from the inner space of the spool 41), hydraulic oil is supplied to the advance angle chamber Ca, and at this time, hydraulic oil is discharged from the retarded angle chamber Cb (flow of hydraulic oil is indicated by arrows in FIG. 5).

Thus, the rotational phase of the intake cam shaft 5 is displaced in the advance angle direction Sa.

Furthermore, if the spool 41 is set to be in the advance angle position and hydraulic oil is supplied to the advance angle flow path 34, when the lock mechanism L is in a lock state, hydraulic oil is supplied from the advance angle flow path 34 to the lock concave section of the lock mechanism L, the lock member 25 is disengaged from the lock concave section, and the lock state of the lock mechanism L is released.

Operations and Effects of Embodiment

Since such an electromagnetic control valve 40 of the valve opening and closing timing control device A includes the spool 41 inside the connecting bolt 50 as the connecting member, supply and discharge of hydraulic oil with respect to the advance angle chamber Ca and the retarded angle chamber Cb of the valve opening and closing timing control device A are controlled from a position close to the advance angle chamber Ca and the retarded angle chamber Cb and it is possible to rapidly operate the advance angle chamber Ca and the retarded angle chamber Cb of the valve opening and closing timing control device A.

Particularly, since the fluid supply path 58 for supplying hydraulic oil to the plurality of pump ports 51*p* of the spool chamber 50*a* of the connecting bolt 50 engaging with the intake cam shaft 5 is linearly formed with respect to the connecting bolt 50, pressure loss in the flow path is reduced. Furthermore, for example, it does not cause a disadvantage that hydraulic oil leaks between a plurality of members compared to a configuration in which the fluid supply path 58 is formed in a hole shape passing through the plurality of members.

Furthermore, since the pump port region IP in which the pump ports 51*p* are present in the direction along the rotational axis X is disposed so that a part thereof overlaps the retarded angle port 51*a* and the advance angle port 51*b*, for example, it is possible to reduce the valve space in the direction along the rotational axis X and to miniaturize the spool 41 compared to a case where the pump port 51*p*, the retarded angle port 51*a*, and the advance angle port 51*b* are linearly disposed.

A valve opening and closing timing control device according to an aspect of this disclosure includes a driving-side rotating body that is disposed coaxially with a rotational axis and rotates in synchronization with a crankshaft of an internal combustion engine; a driven-side rotating body that is disposed coaxially with the rotational axis and integrally rotates with a valve opening and closing cam shaft; a connecting member that is screwed into the cam shaft for connecting the driven-side rotating body to the cam shaft and has a pump port to which a fluid is supplied, an advance angle port which communicates with an advance angle chamber formed by being partitioned by the driving-side rotating body and the driven-side rotating body, and a retarded angle port which communicates with an retarded angle chamber formed by being partitioned by the driving-side rotating body and the driven-side rotating body; a spool that is accommodated within an internal space of the connecting member so as to reciprocally move between an advance angle position, a neutral position, and a retarded angle position along the rotational axis; and an actuator that causes a pressing force to act in a direction along rotational axis and operates the spool to be in the neutral position, the advance angle position, or the retarded angle position, in which when the spool is in the neutral position, the pump port is maintained in a state of not communicating with the advance angle port and the retarded angle port, when the spool is in the advance angle position, the pump port communicates with the advance angle port, and when the spool is in the retarded angle position, the pump port communicates with the retarded angle port, and a fluid supply path allowing the fluid supplied from an external pump to flow into the pump port is formed in the connecting member and the fluid supply path reaches the pump port from an outside position so as to be along the rotational axis more than the advance angle port or the retarded angle port.

With this configuration, it is possible to supply the fluid from the external pump from the outside position to the pump port through the fluid supply path in the direction along the rotational axis more than the advance angle port or the retarded angle port. Furthermore, since the fluid supply path is formed with respect to the connecting member, it is possible to suppress an increase in the number of components and also to suppress leakage of the fluid by forming the fluid supply path with a single connecting member.

Thus, the valve opening and closing timing control device performing control of the fluid by the spool disposed coaxially with the cam shaft is configured with high performance and low cost.

In the aspect of this disclosure, the connecting member may be screwed into the cam shaft and a fluid supply space to which the fluid is supplied from the pump is formed between an outer surface of the connecting member and an inner surface of the cam shaft, and the fluid supply path may be formed in a region over the pump port from the fluid supply space in a posture inclined with respect to the rotational axis.

With this configuration, since it is possible to form the fluid supply path with respect to the connecting member prior to be fixed to the cam shaft, easy processing is realized. Furthermore, if the flow path supplying the fluid from the external pump from the outer periphery of the cam shaft to the outer surface of the bolt member is formed, easy processing is realized. As described above, since it is possible to independently process two types of the flow paths, easy manufacturing is also realized.

In the aspect of this disclosure, in the internal space, the advance angle port and the retarded angle port may be formed at positions deviated by a predetermined angle in a circumferential direction about the rotational axis based on the pump port, and a region, in which a region where the pump port is present in a direction along the rotational axis and a region where at least one of the advance angle port and the retarded angle port is present are overlapped each other, may be provided.

With this configuration, since the region where the pump port is present in the direction along the rotational axis and the region where at least one of the advance angle port and the retarded angle port is present overlap each other, it is possible to shorten dimensions of the internal space and the spool in the direction along the rotational axis. Furthermore, if the fluid of the pump port is supplied to the advance angle port or the retarded angle port, it is also possible to shorten an operation stroke of the spool.

Other Embodiments

The embodiment disclosed here may be configured as follows in addition to the embodiment described above.

Figure 8:
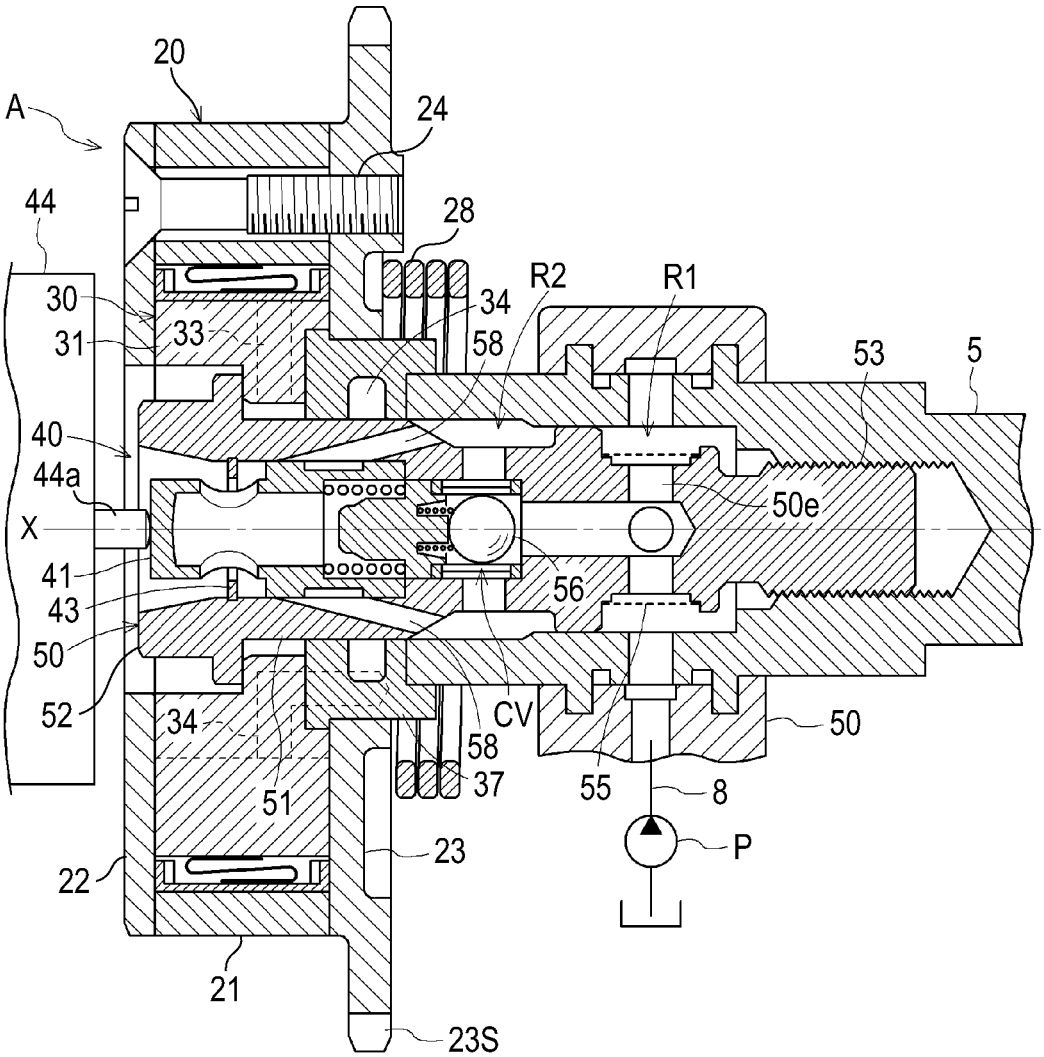
FIG. 8 is a sectional view of a valve opening and closing timing control device of another embodiment.

(a) As illustrated in FIG. 8, a connecting bolt 50 is configured as the connecting member. A dimension of the connecting bolt 50 in the direction along the rotational axis X is set to be longer than that illustrated in the first embodiment. A plurality of supply hole sections 50*e* communicating with each other in the radial direction are formed at positions in the vicinity of a male screw section 53. An oil filter 55 is provided in an outer peripheral portion of a region communicating with the supply hole sections 50*e*.

Also in the configuration of the other embodiment (a), a fluid supply path 58 in the posture inclined with respect to the rotational axis X is formed in the connecting bolt 50 and the same operations and effects as the embodiment are obtained.

(b) A fluid supply path 58 is configured in a groove shaped portion with respect to an outer peripheral surface or an inner peripheral surface of a connecting bolt 50 (connecting member). That is, if the fluid supply path 58 is formed in the outer peripheral surface, a pump port 51*p* is formed in a hole shape with respect to a connecting bolt 50 and the fluid supply path 58 is formed in a groove shape from a second hydraulic oil chamber R2 (fluid supply space) over the pump port 51*p* with respect to the outer peripheral surface of the connecting bolt 50. Furthermore, if the fluid supply path 58 is formed in the inner periphery surface, the pump port 51*p* is formed in the hole shape with respect to the connecting bolt 50, a hole section communicating with the second hydraulic oil chamber R2 (fluid supply space) is formed with respect to the inner peripheral surface of the connecting bolt 50, and the fluid supply path 58 is formed in a groove shape connected from the hole section to the pump port 51*p*. In addition, as illustrated in FIG. 3, in the configuration in which the advance angle port 51*b* is formed between the second hydraulic oil chamber R2 and the pump port 51*p*, the fluid supply path 58 that is formed as the groove shaped section in the inner surface or the outer surface of the connecting bolt 50 is disposed in a region which does not overlap the advance angle port 51*b*.

Also in the configuration as the other embodiment (b), since the fluid supply path 58 is formed with respect to one connecting bolt 50, it is possible to suppress leakage of hydraulic oil (fluid).

(c) In the first embodiment, the advance angle flow path 34 is formed in the adapter 37, but the advance angle flow path 34 formed in the inner rotor 30 may be configured to be directly connected to the advance angle port 51*b* without including the adapter 37. According to the configuration, it is possible to suppress leakage of the fluid of the advance angle flow path 34.

(d) In the invention, the retarded angle position and the advance angle position may be arranged by reversely setting the arrangement of the retarded angle port 51*a* and the advance angle port 51*b* illustrated in the embodiment described above. Thus, it becomes the advance angle position by retracting the plunger 44*a* and it becomes the retarded angle position by causing the plunger 44*a* to protrude based on the neutral position.

The invention can be used in a valve opening and closing timing control device for controlling a fluid with respect to an advance angle chamber and a retarded angle chamber by a spool disposed coaxially with the cam shaft.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control device comprising:

a driving-side rotating body that is disposed coaxially with a rotational axis and rotates in synchronization with a crankshaft of an internal combustion engine;

a driven-side rotating body that is disposed coaxially with the rotational axis and integrally rotates with a valve opening and closing cam shaft;

a connecting member that is screwed into the cam shaft for connecting the driven-side rotating body to the cam shaft and has a pump port to which a fluid is supplied, an advance angle port which communicates with an advance angle chamber formed by being partitioned by the driving-side rotating body and the driven-side rotating body, and a retarded angle port which communicates with an retarded angle chamber formed by being partitioned by the driving-side rotating body and the driven-side rotating body;

a spool that is accommodated within an internal space of the connecting member so as to reciprocally move between an advance angle position, a neutral position, and a retarded angle position along the rotational axis; and an actuator that causes a pressing force to act in a direction along rotational axis and operates the spool to be in the neutral position, the advance angle position, or the retarded angle position, wherein when the spool is in the neutral position, the pump port is maintained in a state of not communicating with the advance angle port and the retarded angle port, when the spool is in the advance angle position, the pump port communicates with the advance angle port, and when the spool is in the retarded angle position, the pump port communicates with the retarded angle port, and wherein a fluid supply path allowing the fluid supplied from an external pump to flow into the pump port is formed in the connecting member and the fluid supply path reaches the pump port from an outside position so as to be along the rotational axis more than the advance angle port or the retarded angle port.

2. The valve opening and closing timing control device according to claim 1, wherein the connecting member is screwed into the cam shaft and a fluid supply space to which the fluid is supplied from the pump is formed between an outer surface of the connecting member and an inner surface of the cam shaft, and wherein the fluid supply path is formed in a region over the pump port from the fluid supply space in a posture inclined with respect to the rotational axis.

3. The valve opening and closing timing control device according to claim 1, wherein in the internal space, the advance angle port and the retarded angle port are formed at positions deviated by a predetermined angle in a circumferential direction about the rotational axis based on the pump port, and a region, in which a region where the pump port is present in a direction along the rotational axis and a region where at least one of the advance angle port and the retarded angle port is present overlap each other, is provided.

4. The valve opening and closing timing control device according to claim 2, wherein in the internal space, the advance angle port and the retarded angle port are formed at positions deviated by a predetermined angle in a circumferential direction about the rotational axis based on the pump port, and a region, in which a region where the pump port is present in a direction along the rotational axis and a region where at least one of the advance angle port and the retarded angle port is present overlap each other, is provided.

* * * * *